US008590246B2

(12) United States Patent
Coccagna

(10) Patent No.: US 8,590,246 B2
(45) Date of Patent: Nov. 26, 2013

(54) MASONRY SPACER

(71) Applicant: Daniel Coccagna, Philadelphia, PA (US)

(72) Inventor: Daniel Coccagna, Philadelphia, PA (US)

( * ) Notice: Subject to any disclaimer, the term of this patent is extended or adjusted under 35 U.S.C. 154(b) by 0 days.

(21) Appl. No.: 13/718,478

(22) Filed: Dec. 18, 2012

(65) Prior Publication Data

US 2013/0167469 A1 Jul. 4, 2013

Related U.S. Application Data

(60) Provisional application No. 61/582,992, filed on Jan. 4, 2012.

(51) Int. Cl.
*E04C 5/16* (2006.01)
*E04B 2/16* (2006.01)

(52) U.S. Cl.
USPC ..... 52/442; 52/379; 52/565; 52/677

(58) Field of Classification Search
USPC ..... 52/12, 241, 307, 308, 442, 565, 677, 52/684, 687, 836, 846, 852, 712
See application file for complete search history.

(56) References Cited

U.S. PATENT DOCUMENTS

| | | | | | |
|---|---|---|---|---|---|
| 2,124,799 | A | | 7/1938 | Specht | |
| 2,275,109 | A | * | 3/1942 | McGee | 52/481.1 |
| 2,318,362 | A | | 5/1943 | Boeglen et al. | |
| 2,929,238 | A | | 3/1960 | Kaye | |
| 3,333,390 | A | * | 8/1967 | Banning | 52/846 |
| 3,420,560 | A | | 1/1969 | Pfahning | |
| 3,426,497 | A | * | 2/1969 | Mundy | 52/677 |
| 4,136,498 | A | | 1/1979 | Kanigan | |
| 4,229,922 | A | * | 10/1980 | Clark, Jr. | 52/442 |
| 4,651,484 | A | * | 3/1987 | Rutkowski | 52/241 |
| 4,689,931 | A | * | 9/1987 | Hodges | 52/442 |
| 4,833,848 | A | * | 5/1989 | Guerin | 52/242 |
| 4,986,048 | A | | 1/1991 | McMarlin | |
| 5,010,704 | A | | 4/1991 | Thompson | |
| 5,193,320 | A | | 3/1993 | Coccagna | |
| 5,845,444 | A | * | 12/1998 | Besche | 52/421 |
| 5,899,036 | A | * | 5/1999 | Seiber et al. | 52/241 |
| 5,899,041 | A | * | 5/1999 | Durin | 52/660 |
| 6,094,872 | A | * | 8/2000 | Ward et al. | 52/126.4 |
| 6,138,425 | A | * | 10/2000 | Wendt | 52/506.07 |
| 6,553,737 | B1 | * | 4/2003 | Berg | 52/687 |
| 6,629,393 | B2 | * | 10/2003 | Pignataro | 52/677 |
| 7,747,177 | B2 | | 6/2010 | Chen et al. | |

(Continued)

FOREIGN PATENT DOCUMENTS

| | | |
|---|---|---|
| AU | 495821 | 10/1976 |
| GB | 22263 | 5/1907 |

*Primary Examiner* — Robert Canfield
(74) *Attorney, Agent, or Firm* — Mendelsohn, Drucker & Dunleavy, P.C.; Craig M. Brown

(57) ABSTRACT

In one embodiment, a masonry spacer has (i) an elongated and substantially planar body, and (ii) first and second elongated support members. The planar body has one or more bendable tabs formed therein and defines a first plane of the masonry spacer. The first and second support members each (i) have at least one corresponding channel formed therein, (ii) have one or more openings formed therein, and (iii) extend laterally from a different elongated side of the planar body. Further, the first and second support members define a second plane of the masonry spacer offset from the first plane. An outer edge of each of the first and second elongated support members defines a third plane of the masonry spacer that is intermediate to the first and second planes.

10 Claims, 4 Drawing Sheets

(56) References Cited

U.S. PATENT DOCUMENTS 7,788,875 B2 * 9/2010 Wendt ..... 52/712
8,205,394 B1 * 6/2012 Jackman et al. ..... 52/35
2004/0182029 A1 * 9/2004 Berg ..... 52/379
2005/0072107 A1 * 4/2005 Kebeli ..... 52/720.1
2011/0283648 A1 * 11/2011 Vitt et al. ..... 52/565

* cited by examiner

MASONRY SPACER

CROSS-REFERENCE TO RELATED APPLICATIONS

The subject matter of this application is related to U.S. Pat. No. 5,193,320 (the '320 patent), the teachings of which are incorporated herein by reference in their entirety.

This application claims the benefit of the filing date of U.S. provisional application No. 61/582,992, filed on Jan. 4, 2012, the teachings of all of which are incorporated herein by reference in their entirety.

BACKGROUND

1. Field of the Invention

The present invention relates to the laying of masonry elements such as blocks and bricks, and, more specifically but not exclusively, to devices for securing masonry elements to one another.

2. Description of the Related Art

U.S. Pat. No. 5,193,320 discloses an implementation of a masonry spacer that may be used to space two courses of masonry apart from one another. The masonry spacer in the '320 patent comprises two elongated and inverted V-shaped support members that are substantially parallel to one another and spaced apart by relatively thin planar bars.

FIG. 3A shows an isometric view of another implementation of a masonry spacer 10, and FIG. 3B shows an end view of masonry spacer 10. Masonry spacer 10 also comprises first and second elongated support members 12 and 14 that have an inverted "V" shape. The inverted "V" shape of first support member 12 is formed from a first support sub-member 12*a* and a second support sub-member 12*b* that are adjoined along edge 20 of the inverted "V" shape, and the inverted "V" shape of second support member 14 is formed from a first support sub-member 14*a* and a second support sub-member 14*b* that are adjoined along edge 22 of the inverted "V" shape.

Unlike the support members of the masonry spacer in the '320 patent, support members 12 and 14 also have a non-inverted V-shape. In particular, the non-inverted V-shape of first support member 12 is formed from second support sub-member 12*b* and a third support sub-member 12*c*, and the non-inverted V-shape of second support member 14 is formed from second support sub-member 14*b* and a third support sub-member 14*c*. Support members 12 and 14 are joined together by an elongated and substantially planar body 26 rather than the thin planar bars used in the '320 patent to give further strength to masonry spacer 10.

Masonry laying device 10, which may be installed between two courses of masonry in a manner similar to that of the masonry spacer described in the '320 patent, defines two planes 16 and 18 separated by a distance H1. When installed between two courses of masonry, first plane 16 rests on the upper surface of the lower course of masonry, and the lower surface of the upper course of masonry rests on second plane 18.

Masonry spacer 10 and the masonry spacer described in the '320 patent provide reliable spacing between two courses of masonry. However, these spacers do not adequately secure to the masonry elements or adequately reinforce the masonry elements.

SUMMARY

In one embodiment, the present invention is a masonry spacer comprising a substantially planar body and first and second elongated support members. The substantially planar body defines a first plane of the masonry spacer. The first and second elongated support members each define at least one corresponding channel extending laterally along a different side of the planar body. Further, the first and second elongated support members define a second plane of the masonry spacer offset from the first plane. The masonry spacer is further defined by at least one of: (a) one or both of the first and second elongated support members having one or more apertures formed therein, (b) the substantially planar body having one or more bendable tabs formed therein, and (c) an outer edge of one or both of the first and second elongated support members defining a third plane of the masonry spacer that is intermediate to the first and second planes.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

Figure 1A:
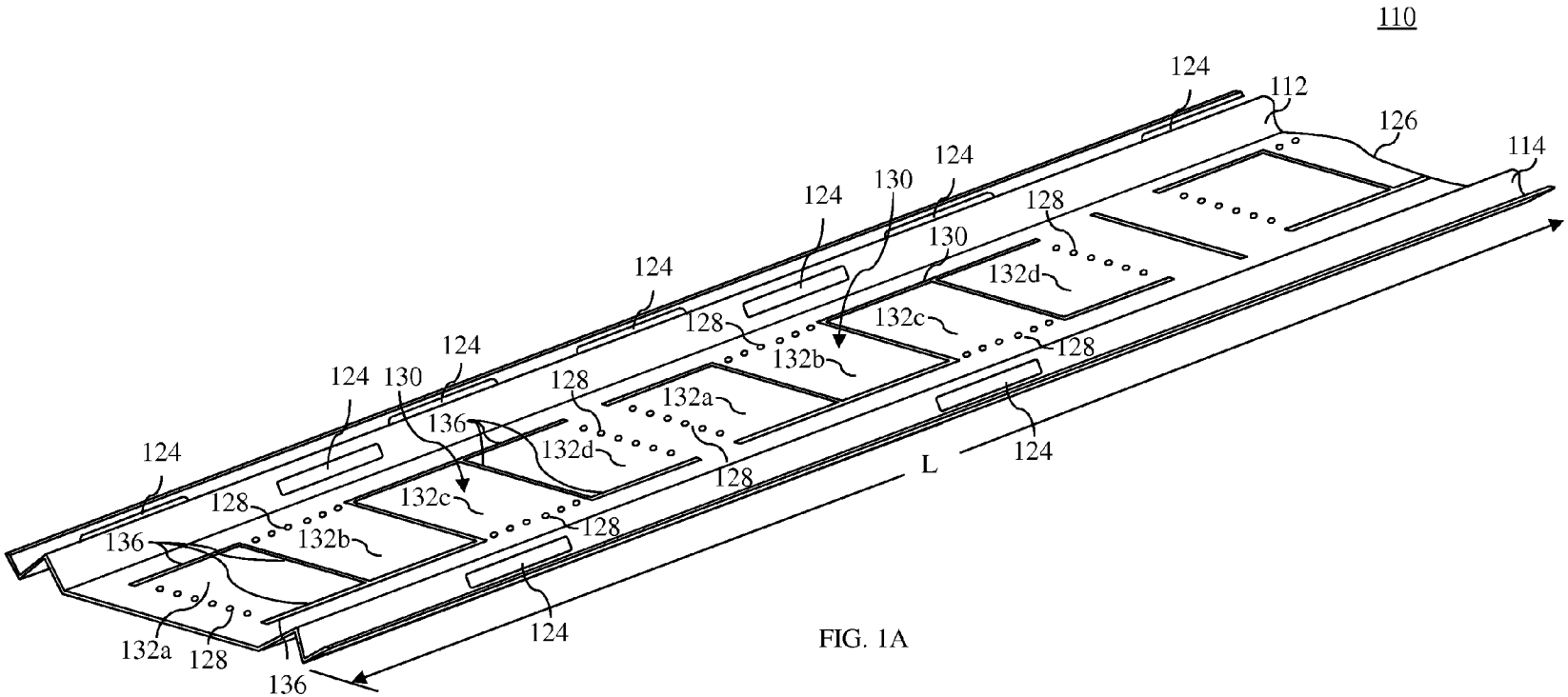
FIG. 1A shows an isometric view of a masonry spacer according to one embodiment of the disclosure.
Figure 1B:
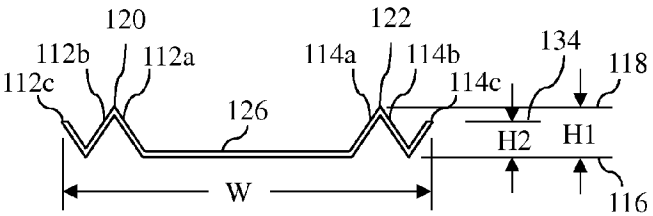
FIG. 1B shows an end view of the masonry spacer of FIG. 1A.

FIG. 1A shows an isometric view of a masonry spacer 110 according to one embodiment of the disclosure, and FIG. 1B shows an end view of masonry spacer 110. Masonry spacer 110 has a first rigid support member 112 and a second rigid support member 114, which are spaced apart by an elongated, planar body 126. The lower surface of planar body 126 defines a first plane 116 of masonry spacer 110. Planar body 126 may have a length L that spans the length of an entire course of masonry elements, or according to alternative embodiments of the disclosure, a length L that is less than or greater than the length of a single masonry element.

Planar body 126 has a plurality of patterns 130 formed therein, wherein each pattern 130 corresponds to one opening in a masonry element, such as one of the two openings in a cinder block. Each pattern 130 is a set of seven interconnected slots 136 formed in planar body 126 using any suitable technique such as stamping. Further, the slots 136 of each pattern 130 define four tabs 132(*a*)-132(*d*) that may be depressed by bending the tabs into the corresponding opening of the masonry element above and/or below masonry spacer 110 to position masonry spacer 110 and secure it to the masonry element or elements. In the embodiment of FIG. 1, the four tabs 132(*a*)-132(*d*) of each pattern 130 are formed such that, when depressed, each tab is adjacent to a different one of the four inner walls in the opening of the masonry element.

To aid the user in depressing tabs 132(*a*)-132(*d*), perforations 128 are formed in planar body 126, which provide a line along which tabs 132(*a*)-132(*d*) may be bent. Each perforation 128 comprises a set of (e.g., six) aligned holes in planar body 126 using any suitable technique such as stamping. By removing some of the material of planar body 126, each perforation reduces the amount of force that is needed to bend the corresponding tab.

First support member 112 comprises an inverted, elongated V-shaped channel and a non-inverted, elongated V-shaped channel, both of which span the length of planar body 126. The inverted V-shaped channel is formed from a first support sub-member 112*a* and a second support sub-member 112*b* that are adjoined along edge 120 of the inverted "V" shape. The non-inverted V-shaped channel is formed from second support sub-member 112*b* and entrapment sub-member 112*c*. Similarly, second support member 114 comprises (i) an inverted, elongated V-shaped channel formed from a first support sub-member 114*a* and a second support sub-member 114*b* that are adjoined along edge 122 of the inverted "V" shape, and (ii) a non-inverted, elongated V-shaped channel formed from second support sub-member 114*b* and an entrapment sub-member 114*c*. Edge 120 of support member 112 and edge 122 of support member 114 define a second plane 118 of masonry spacer 110.

Figure 3A:
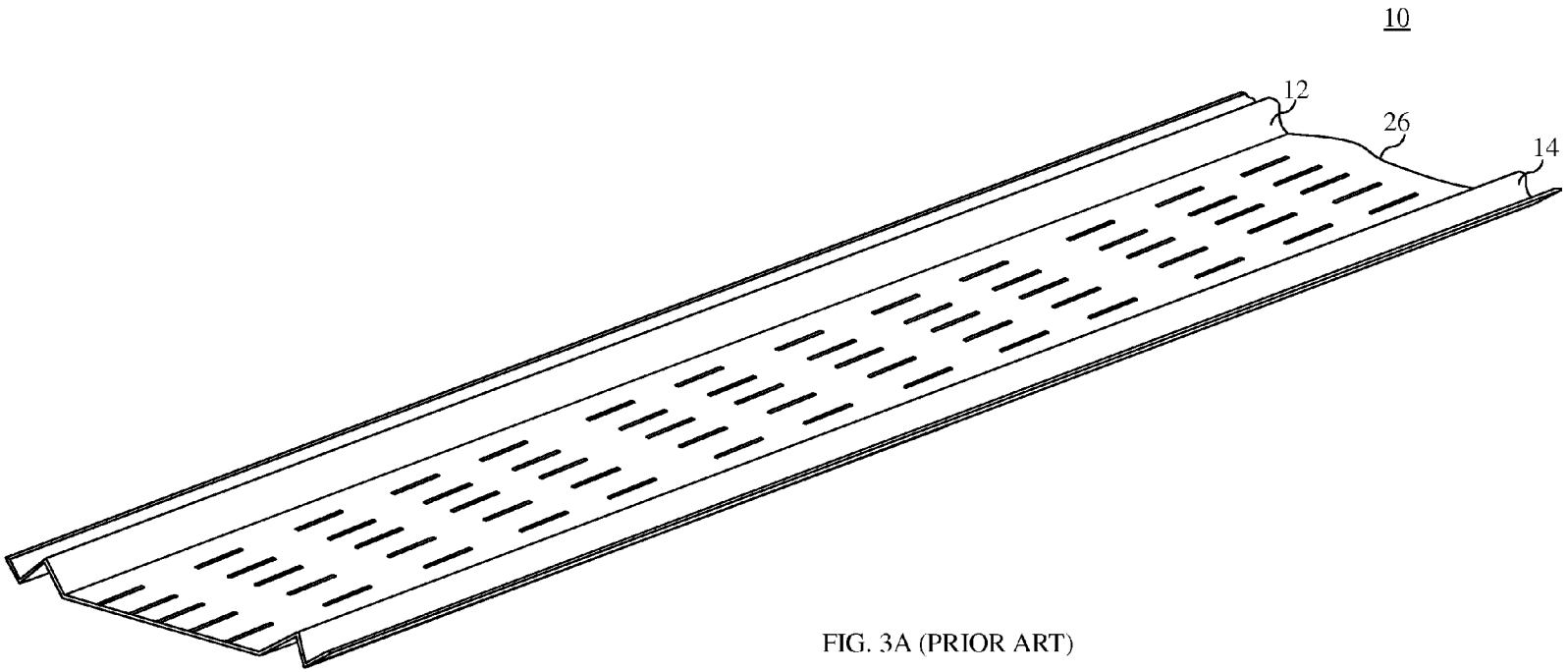
FIG. 3A (PRIOR ART)
FIG. 3A shows an isometric view of one implementation of a masonry spacer.
Figure 3B:
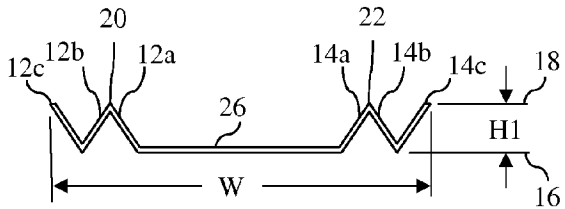
FIG. 3B (PRIOR ART)
FIG. 3B shows an end view of the masonry spacer of FIG. 3A.

First support member 112 and second support member 114, which are used to space courses of masonry elements from one another, are similar to support members 12 and 14 of FIG. 3, respectively. However, support members 112 and 114 have several additional features that allow mortar to pass into, and thereby become entrapped within, their respective V-shaped channels. First, each support member has one or more openings 124 formed therein through which mortar may pass when using the masonry spacer to lay masonry. In the embodiment in FIG. 1A, openings 124 are slot-shaped openings formed in each sub-member (i.e., 112*a*-112*c* and 114*a*-114*c*) of each support member. However, according to alternative embodiments of the disclosure, openings 124 may (i) have any other suitable shape, (ii) be formed in only one support member (i.e., 112 or 114), and/or (iii) be formed in fewer than all of the support sub-members (i.e., 112*a*-112*c* and 114*a*-114*c*).

Second, as shown in FIG. 1B, entrapment sub-members 112*c* and 114*c* extend to a third plane 134 of masonry spacer 110 that is intermediate to first and second planes 116 and 118. In other words, entrapment sub-members 112*c* and 114*c* extend from first plane 116 to a height H2 that is shorter than the height H1 of second plane 118 above first plane 116. The gap between second plane 118 and third plane 134 (i.e., the difference between H1 and H2) allows mortar to flow into or out of (i) the V-shaped channel formed by support sub-member 112*b* and entrapment sub-member 112*c* and (ii) the V-shaped channel formed by support sub-member 114*b* and entrapment sub-member 114*c*.

Figure 2A:
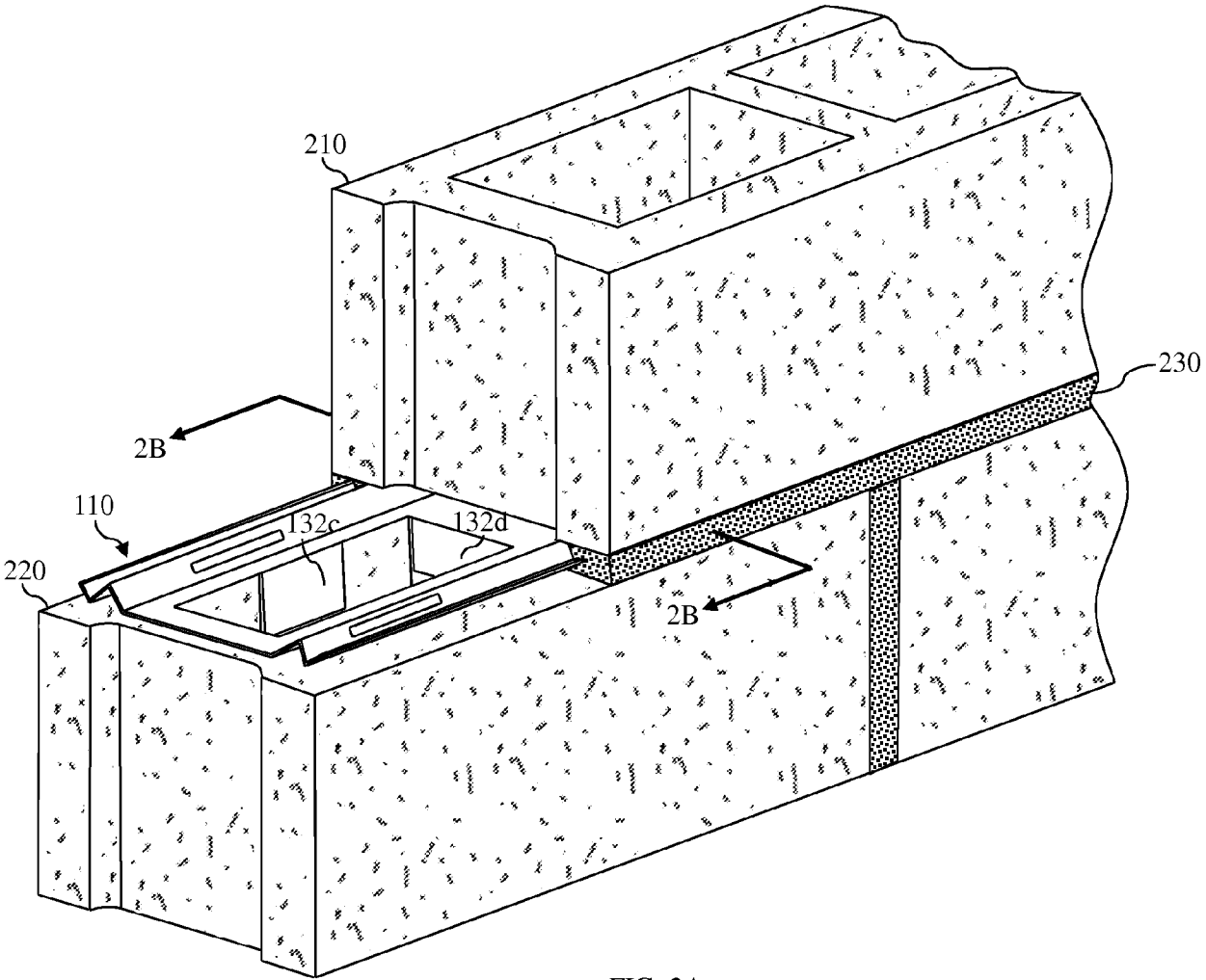
FIG. 2A shows an isometric view of the masonry spacer of FIG. 1A installed between two courses of masonry elements according to one embodiment of the disclosure.
Figure 2B:
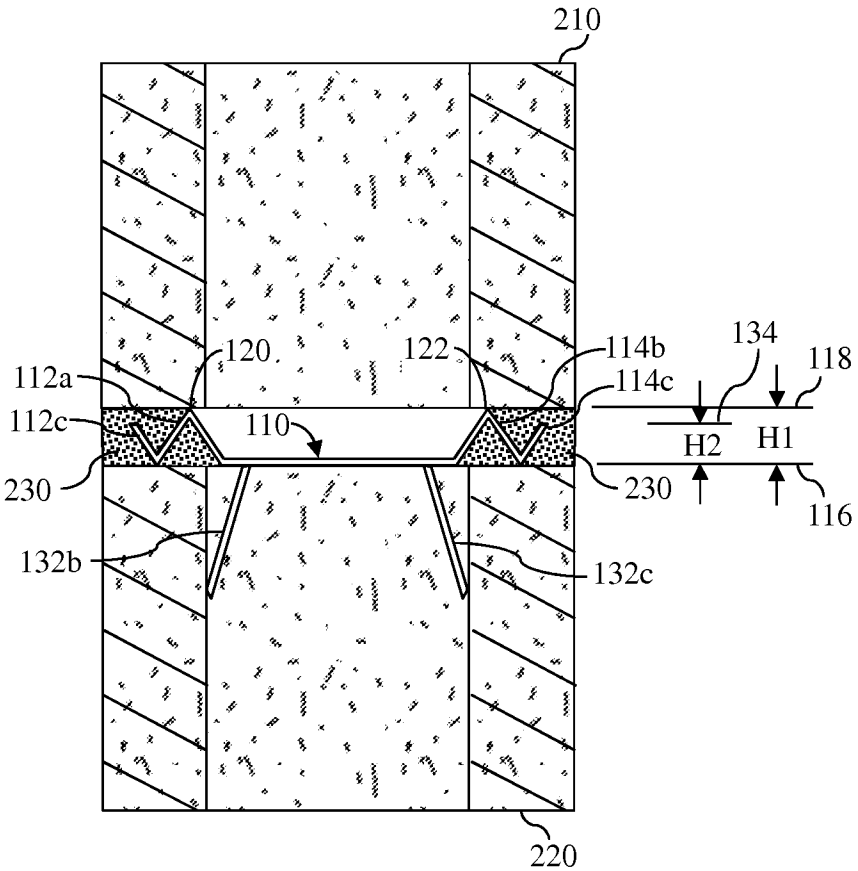
FIG. 2B shows a section view of the masonry spacer of FIG. 1A installed between two courses of masonry elements.

FIG. 2A shows an isometric view of masonry spacer 110 installed between two courses 210 and 220 of masonry elements according to one embodiment of the disclosure, and FIG. 2B shows a section view of masonry spacer 110 installed between two courses 210 and 220 of masonry elements. With the exception of bending tabs 132*a*, 132*b*, 132*c*, and 132*d*, masonry spacer 110 may be installed in substantially the same manner as the masonry device described in the '320 patent. As shown, masonry spacer 110 is placed on top of lower course 220 and positioned with respect to lower course 220 by bending tabs 132*a* (not visible in FIG. 2), 132*b*, 132*c*, and 132*d* corresponding to each pattern 130 down into a corresponding opening of the masonry element in lower course 220.

Mortar 230 may then be spread across the top of masonry spacer 110 and the top of lower course 220. As shown, mortar 230 fills (i) the elongated V-shaped channel formed by entrapment sub-member 112*c* and support sub-member 112*b* of support member 112 and (ii) the elongated V-shaped channel formed by entrapment sub-member 114*c* and support sub-member 114*b* of support member 114. Mortar 230 also fills (i) the space between entrapment sub-member 112*c* and the top of lower course 220 (ii) the space between entrapment sub-member 114*c* and the top of lower course 220. Filling the spaces around entrapment sub-members 112*c* and 114*c* allows entrapment sub-members 112*c* and 114*c* to become entrapped within the mortar.

After applying mortar 230, a masonry element of upper course 210 is positioned onto masonry spacer 110 such that the bottom of the masonry element rests on edges 120 and 122 of support members 112 and 114, respectively. Support members 112 and 114 form a substantially fixed space between upper course 210 and lower course 220. As mortar 230 hardens, the masonry element of upper course 210 becomes securely attached to masonry spacer 110 and lower course 220.

Note that, in installing masonry spacer 110, mortar is permitted to flow into and out of openings 124 and into and out of the gaps between second plane 118 and third plane 134 such that the mortar on both sides of each sub-member (i.e., 112*a*-*c*, and 114*a*-*c*) is coupled together, thereby securing each sub-member within the mortar. By allowing mortar to pass into the elongated V-shaped channels of masonry spacer 110, through the openings 124, and through the gap between second plane 118 and third plane 134, masonry walls built using masonry spacer 110 may be structurally stronger than masonry walls built using masonry spacer 10 of FIGS. 3A and 3B and the masonry spacer of the '320 patent.

In FIGS. 2A and 2B, masonry spacer 110 is oriented horizontally such that (i) the first plane 116 of masonry spacer 110 rests on upper surface of lower course 220 and (ii) the lower surface of upper course 210 rests on the second plane 118 of masonry spacer 110. Note, however, that the orientation of masonry spacer 110 may be reversed such that (i) the second plane 118 of masonry spacer 110 rests on upper surface of lower course 220 and (ii) the lower surface of upper course 210 rests on the first plane 116 of masonry spacer 110. Further, masonry spacer 110 may be oriented vertically between horizontally adjacent masonry elements.

Although masonry spacer 110 is implemented with two inverted V-shaped channels and two non-inverted V-shaped channels, embodiments of the disclosure are not so limited. According to alternative embodiments, masonry spacer of the disclosure may be implemented with channels having shapes other than a "V" shape. For example, one or more channels may have a square, rectangular, or semi-circular shape.

Further, embodiments of the disclosure are not limited to having two support members. Various embodiments of the disclosure may have one or more support members. In embodiments having a single support member, the support member should preferably be wide enough to support a masonry element of the course above. For example, a single support member could extend from edge 120 to edge 122.

Although an embodiment of the disclosure was described relative to a specific pattern 130 defining four tabs 132(*a*)-

132(*d*), embodiments of the disclosure are not so limited. Various embodiments of the disclosure may be implemented using a pattern that defines one or more tabs. Further, embodiments of the disclosure are not limited to having perforations 128 for depressing the tabs. Yet further, various embodiments of the disclosure may have perforations that are formed using fewer than or more than six holes and/or holes that have shapes other than circles, such as elongated slots.

Although the support members shown in FIG. 1A are substantially parallel, embodiments of the disclosure are not so limited. According to alternative embodiments, the support members may be at an acute angle to one another.

Masonry spacers of the disclosure may be fabricated and installed using any suitable techniques, including, but not limited to those techniques described in the '320 patent. For example, masonry spacers of the disclosure can be installed by laying the lower course, applying mortar, positioning the masonry spacer, applying mortar, and laying the upper course, in that order. Yet further, masonry spacers of the disclosure can be installed by laying the lower course, applying mortar, positioning the masonry spacer, and laying the upper course, in that order.

Masonry spacers of the disclosure may be installed such that the masonry spacers span across one or more masonry elements in the lower course and one or more masonry elements in the upper course. Further, the masonry elements may be different sizes between courses and even within courses.

It will be understood that various changes in the details, materials, and arrangements of the parts which have been described and illustrated in order to explain the nature of this invention may be made by those skilled in the art without departing from the scope of the invention.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A masonry spacer comprising:

a substantially planar body defining a first plane of the masonry spacer; and first and second elongated support members, each defining at least one corresponding channel extending laterally along a different side of the planar body, wherein the first and second elongated support members define a second plane of the masonry spacer offset from the first plane, wherein:

at least one of the first and second elongated support members comprises first, second, and third sub-members, wherein:

a first edge of the first sub-member is joined to the substantially planar body;

a second edge of the first sub-member is joined to a first edge of the second sub-member to form a first V-shaped channel; and a second edge of the second sub-member is joined to a first edge of the third sub-member to form a second V-shaped channel;

one or both of the first and second elongated support members has one or more openings formed therein;

the substantially planar body has one or more bendable tabs formed therein; and an outer edge of one or both of the first and second elongated support members defines a third plane of the masonry spacer that is intermediate to the first and second planes.

2. The masonry spacer of claim 1, wherein:

the second edge of the first sub-member and the first edge of the second sub-member define the second plane; and a second edge of the third sub-member is the outer edge defining the third plane.

3. A masonry spacer comprising:

a substantially planar body defining a first plane of the masonry spacer; and first and second elongated support members, each defining at least one corresponding channel extending laterally along a different side of the planar body, wherein the first and second elongated support members define a second plane of the masonry spacer offset from the first plane, wherein:

(a) one or both of the first and second elongated support members has the one or more openings formed therein;

(b) the substantially planar body has the one or more bendable tabs formed therein; and (c) the outer edge of one or both of the first and second elongated support members defines the third plane of the masonry spacer that is intermediate to the first and second planes.

4. The masonry spacer of claim 3, wherein the one or more openings are adapted to allow mortar to flow into or out of the at least one corresponding channel when the masonry spacer is positioned between two courses of masonry elements.

5. The masonry spacer of claim 3, wherein the one or more bendable tabs are adapted to secure the masonry spacer to a masonry element.

6. The masonry spacer of claim 5, wherein:

the one or more bendable tabs correspond to an opening in the masonry element; and the one or more bendable tabs are configured to secure the masonry spacer to the opening of the masonry element when the one or more bendable tabs are bent into the opening.

7. The masonry spacer of claim 3, wherein each bendable tab has a perforation formed therein adapted to support bending of the tab.

8. The masonry spacer of claim 3, wherein a space between the third plane and the second plane is adapted to allow mortar to pass into or out of the at least one corresponding channel when the masonry spacer is positioned between two courses of masonry elements.

9. The masonry spacer of claim 3, wherein at least one of the first and second elongated support members comprises first, second, and third sub-members, wherein:

a first edge of the first sub-member is joined to the substantially planar body;

a second edge of the first sub-member is joined to a first edge of the second sub-member to form a first V-shaped channel; and a second edge of the second sub-member is joined to a first edge of the third sub-member to form a second V-shaped channel.

10. The masonry spacer of claim 9, wherein:

the second edge of the first sub-member and the first edge of the second sub-member define the second plane; and a second edge of the third sub-member is the outer edge defining the third plane.

* * * * *